US006799915B2

(12) United States Patent
Sawano

(10) Patent No.: US 6,799,915 B2
(45) Date of Patent: Oct. 5, 2004

(54) IMAGE TRANSFER APPARATUS AND INSERTION PLATFORM USED THEREFOR

(75) Inventor: Mitsuru Sawano, Kanagawa (JP)

(73) Assignee: Fuji Photo Film Co., Ltd., Kanagawa (JP)

( * ) Notice: Subject to any disclaimer, the term of this patent is extended or adjusted under 35 U.S.C. 154(b) by 0 days.

(21) Appl. No.: 09/805,185

(22) Filed: Mar. 14, 2001

(65) Prior Publication Data

US 2001/0051066 A1 Dec. 13, 2001

(30) Foreign Application Priority Data

Mar. 14, 2000 (JP) ..... P. 2000-070597

(51) Int. Cl.[7] ..... B41J 13/26
(52) U.S. Cl. ..... 400/633.1; 400/703
(58) Field of Search ..... 400/625, 631, 400/632, 633.1, 636, 703, 708; 271/227, 241; 399/389, 390, 391

(56) References Cited

U.S. PATENT DOCUMENTS 4,463,673 A * 8/1984 Moore ..... 101/129
4,599,122 A * 7/1986 Nakamura ..... 156/64
5,196,868 A * 3/1993 No et al. ..... 346/134
5,226,366 A * 7/1993 Schlife et al. ..... 101/485
5,241,187 A * 8/1993 Ikeda et al. ..... 250/548
5,664,495 A * 9/1997 Winter ..... 101/114
5,859,496 A * 1/1999 Murazaki et al. ..... 313/485
6,000,871 A * 12/1999 Fisher, Sr. ..... 400/706
6,120,199 A * 9/2000 Takekoshi ..... 400/611
6,227,732 B1 * 5/2001 Higuchi et al. ..... 400/624
6,283,471 B1 * 9/2001 Kunzel et al. ..... 271/227
6,315,473 B1 * 11/2001 Slippy ..... 400/578
6,364,556 B1 * 4/2002 Barbera et al. ..... 400/708
6,422,139 B1 * 7/2002 DeCruz ..... 101/127.1

FOREIGN PATENT DOCUMENTS

JP 11-106685 * 4/1999

* cited by examiner

*Primary Examiner*—Ren Yan
(74) *Attorney, Agent, or Firm*—Sughrue Mion, PLLC

(57) ABSTRACT

A part of the insertion platform 3' to send the sheets in which the image receiving sheet on which the image is formed, and the transfer sheet onto which the image is to be transferred, are superimposed, to the heat roller pair to heat and press the sheets, in the image transfer apparatus is structured by the member 2G having a function to transmit the light from the lower side. The light transmission function member is any one of a transparent portion, translucent portion, light diffusion portion, or opening portion, and the light source 2L is arranged on its lower side.

11 Claims, 10 Drawing Sheets

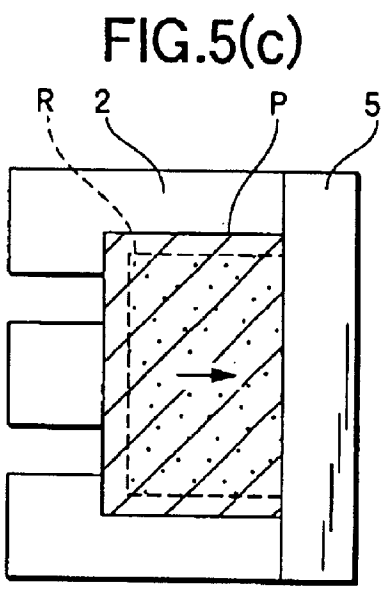
FIG.5(c)
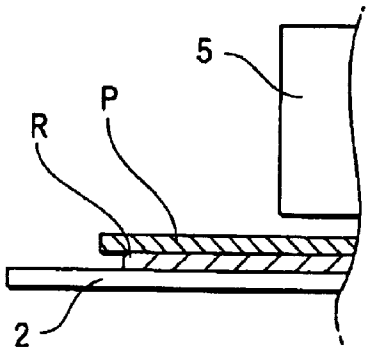
FIG.5(c')
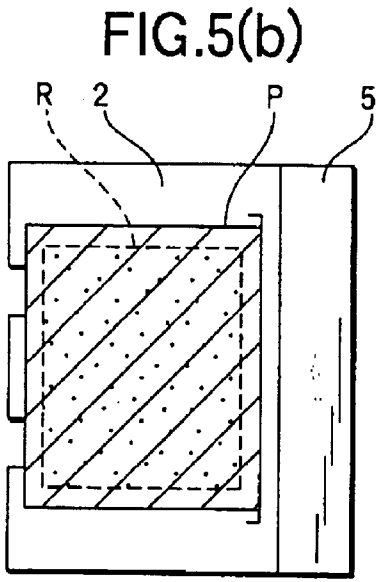
FIG.5(b)
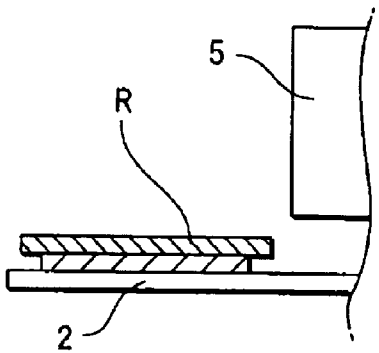
FIG.5(b')
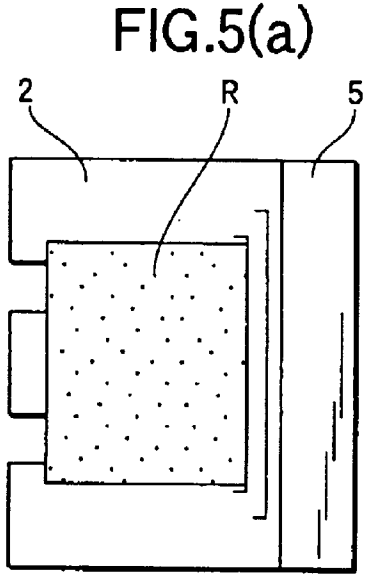
FIG.5(a)
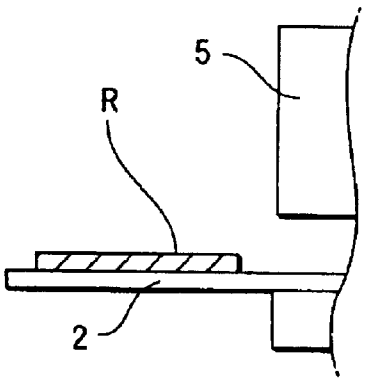
FIG.5(a')

IMAGE TRANSFER APPARATUS AND INSERTION PLATFORM USED THEREFOR

BACKGROUND OF THE INVENTION

1. Field of the Invention

The present invention relates to an image transfer apparatus by which the superimposed sheets in which an image receiving sheet on which an image is formed by a thermal heat-transfer printer, or a laser thermal transfer printer (other than them, any one of printers which can print on the transfer sheet, such as an inkjet printer, may be allowable), and the transfer sheet onto which an image is to be transferred, are superimposed, are passed between the heat roller pair, and an image formed on the image receiving sheet is transferred onto the transfer sheet.

2. Description of the Related Art

When a print plate is made from a color document, and a print of a large number of sheets is conducted, a proof print is conducted and after the finishing is confirmed, then an actual print is conducted. In this case, in a proof print process, a color proof is made and confirmed. Such the color proof is obtained such that, after an image is formed on the image receiving sheet by a thermal printer, an image formed on the image receiving sheet is transferred onto the transfer sheet by an image transfer apparatus.

FIG. 8 shows a conventional general image transfer apparatus. In the same drawing, numeral 1 is an image transfer apparatus, and in this image transfer apparatus, heat rollers 41 and 42 are respectively provided by each one lower and upper being opposed to each other, and on its downstream, nip rollers 51 and 52 are respectively provided upper and lower being opposed to each other. A heat cover 4 covers the periphery of the heat rollers 41 and 42, and prevents the heat dissipation of the heat rollers 41 and 42, and a protective transfer cover 5 further covers its outside including the nip rollers 51 and 52. Further, on the entry side of the image transfer apparatus 1, an insertion platform 2 is provided, and on the one hand, on its delivery side, a delivery base 3 is provided. The heat rollers 41 and 42 are made of, for example, aluminum material, and its outer peripheral surface is covered by a cover layer formed of lubber, and heaters are internally provided at the center of heat rollers 41 and 42. In the heat rollers 41 and 42 provided upper and lower being opposed to each other, one (for example, the lower roller) is for driving, and the other roller (the upper roller) is a driven one. The superimposed sheet of the transfer sheet and the image receiving sheet is passed between the upper and lower heat rollers 41 and 42 while being heated and pressed, and the image on the image receiving sheet is transferred onto the transfer sheet, and after that, an image receiving sheet supporting body is peeled from the transfer sheet by the hand, and the image is obtained on the transfer sheet.

FIG. 9 is a view for explaining in detail the shape of heat roller pair 41 and 42 in FIG. 8, and the heat roller 41 is a driving roller of a straight type of the roller length of 400 mm (that is, a cylindrical type in which all of the diameters of the both ends of heat roller $\phi$1L, $\phi$1R and the diameter $\phi$1C of the central portion are equal, (for example, 35.8 mm)), and the heat roller 42 is a crown type of driven roller of the roller length of 400 mm (that is, a barrel-shape type in which the diameter $\phi$2C of the central portion is a little larger (for example, 36.1 mm) than the diameters $\phi$2L, and $\phi$2R (for example, 35.8 mm)), and both of heat rollers 41 and 42 are covered by a silicon rubber material of the hardness 60° (JIS hardness A).

Onto both sides of the upper side heat roller 42, as the pressing force P, the force of 200±40 N is applied per one side.

Because each of heat roller pair 41 and 42 is supported only at 2 portions of both ends, even when the central portion is deflected a little, by the structure of the combination of the straight-crown types as described above, the uniform pressing force can be obtained at any portion of heat roller pair 41 and 42.

Conventionally, the image transferring is conducted by using such the image transfer apparatus 1 by following 2 methods.

1) One of them is, as shown in FIG. 10, a method in which the image receiving sheet R is superimposed on the transfer sheet P, and the superimposed sheet is passed as it is between the heat roller pair 41 and 42, and the image of the image receiving sheet R is transferred onto the transfer sheet P. That is, in FIG. 10, when the superimposed sheet of the transfer sheet P and the image receiving sheet R which is superimposed on the transfer sheet P, is passed between the upper and lower heat rollers 41 and 42, the superimposed sheet is passed while being heated and pressed, and the image of the image receiving sheet R is transferred onto the transfer sheet P, then, conveyed by the nip rollers 51 and 52, and delivered from the delivery base 3.

In this connection, in this case, when the sheets are passed, the image receiving sheet or the transfer sheet is bent, and the convex and concave wrinkle (hereinafter, called an [indent])is generated. It is considered that its cause is due to the difference of the elongation and shrinkage coming from the difference of material between the transfer sheet P and the image receiving sheet R, or the difference of the thermal expansion rate or humidity absorption rate.

2) In order to solve such the problem, as another method, the present applicant developed a method to use an image transfer apparatus carrier. FIG. 11 shows a transfer method to use the image transfer apparatus carrier.

In FIG. 11, numeral 9 is an image transfer apparatus carrier, and it is structured by a carrier base plate 91 made of a 0.3 mm thick aluminum material, a cover sheet 92 formed of a 0.2 mm thick polyimide material, which covers only the vicinity of the leading edge of the carrier base plate 91 in the advancing direction, and a heat resistive tape 93 to fix the cover sheet 92 to the carrier base plate 91.

In this connection, when the image transfer apparatus carrier 9 is used, initially, the cover sheet 92 is opened, and the superimposed transfer sheet P1 and the image receiving sheet R are inserted between the cover sheet 92 and the carrier base plate 91, and the cover sheet 92 is turned to the original position, and the image receiving sheet and the transfer sheet are nipped from the front and rear surface sides, and the heat resistive tape 93 side is made the leading edge, and the sheets are passed between the heat roller pair 41 and 42.

In this manner, when the image transfer apparatus carrier is used, the transfer sheet P and the image receiving sheet R are nipped between the carrier base plate 91 and the cover sheet 92, and are passed between the heat rollers 41 and 42 while being held by the image transfer carrier 9, thereby, the indent is not generated.

However, the indent is not generated when the image transfer apparatus carrier 9 is used as described above, but, because the heat is absorbed in the aluminum plate, the transmission of the heat becomes undesirable, accordingly, it is necessary that the sheet passing speed is lowered to about 1/10 of the conventional speed, or because it is necessary that the temperature of the heat roller is set higher than the original temperature, the amount of use of the electric power is increased, and it is necessary that the heat resistive temperature of the members is increased, like that the heat resistive structure becomes a large scale. Further, because the image transfer apparatus carrier 9 is ordinary made of an aluminum material, the conveyance path can not be bent, resulting in the hindrance of downsizing of the overall apparatus.

SUMMARY OF THE INVENTION

Accordingly, the present applicant developed previously an image transfer method and an image transfer apparatus thereof in which the image transfer apparatus carrier is not used, and the indent is not generated, and the sheet passing speed is the ordinary one, and the amount of use of the electric power can be realized in the ordinary one, and applied for a patent as U.S. patent application Ser. No. 09/639,161.

According to it, in the image transfer apparatus in which the image receiving sheet on which the image is formed and the transfer sheet onto which the image is to be transferred, are superimposed, and passed from the insertion platform between the heat roller pair, and the image formed on the image receiving sheet is transferred onto the transfer sheet, initially, the image receiving sheet is positioned on the insertion platform, and the transfer sheet is superimposed on it, and these sheets are inserted between the heat roller pair in the superimposed condition.

By using FIG. 12 and FIG. 13, the image transfer method according to the preceding invention will be briefly described below. FIG. 12 is a partial sectional perspective view of the image transfer apparatus according to the preceding invention, and FIG. 13 is a view for explaining the image transfer using the image transfer apparatus in FIG. 12.

In FIG. 12, numeral 1 is the image transfer apparatus, and is structured by heat roller pair 41 and 42, a heat cover 4 to cover it, nip roller pair 51 and 52, a protection cover 5 to cover the heat cover 4 and the nip roller pair 51 and 52, an insertion platform 2, and a delivery base 3. Further, another nip roller pair is provided on the outside of the heat cover 4 on the upstream of the heat roller pair 41 and 42, thereby, the superimposed sheet of the image receiving sheet and the transfer sheet can also be securely nipped. Further, the nip roller pair 51 and 52 may also be neglected.

In FIG. 13, a sign R on the insertion platform 2 of the image transfer apparatus 1 is the image receiving sheet on which the image is formed, and a sign P superimposed on it is the transfer sheet onto which the image is to be transferred. That is, according to the image transfer method according to the preceding invention, as shown in the drawing, the up and down relationship between the transfer sheet and the image receiving sheet is in the reversal relationship to the conventional one. In the conventional image transfer method (FIG. 10), the image receiving sheet R on which the image is formed, is superimposed on the transfer sheet onto which the image is to be transferred, however, herein, in reverse to it, it is a feature that the transfer sheet P is superimposed on the image receiving sheet R. Like this, initially, when the sheets are inserted into the image transfer apparatus in the condition in which the image receiving sheet R is positioned on the insertion platform 2, and the transfer sheet P is superimposed on it, because the transfer sheet which easily includes the humidity is placed in upper portion of them, even when the sheets are heated by the heat rollers 41 and 42, the water content included in the transfer sheet is converted into the water vapor and flies upward, thereby, the wrinkle and indent are not generated.

In this case, in the positional relationship of the image receiving sheet and the transfer sheet, it is preferable that the transfer sheet P is inserted in front of the image receiving sheet R by more than L1 (L1=21 mm). According to this, only the transfer sheet P is passed before, and next the superimposed portion with the image receiving sheet R is passed, and the sheet conveyance failure (ordinary, called [jam]) is reduced.

According to this preceding invention, when the transfer sheet P and the image receiving sheet R are superimposed at the time of insertion, although the positioning of both sheets is improved a little by using a mark, the correct positioning is conducted by looking through the transfer sheet and aligning it to the edge of the lower side image receiving sheet, and because it takes a long period of time, and requires the techniques, the positioning is still inconvenient.

In order to solve the problems, according to the invention of the first aspect, in the insertion platform to send the superimposed sheets in which the image receiving sheet on which the image is formed, and the transfer sheet onto which the image is to be transferred, are superimposed, to the heat roller pair to heat and press the sheets in the image transfer apparatus, the insertion platform is characterized in that a part or the whole of it is structured by a member having a function to transmit the light from the lower side.

Further, according to the invention of the second aspect, the light transmission function member is characterized in that it is any one of a transparent portion, translucent portion, light diffusion portion, or opening portion.

Further, according to the invention of the third aspect, the insertion platform for the image transfer apparatus is characterized in that the light source is provided on the lower side.

Further, according to the invention of the fourth aspect, it is characterized in that a light accumulation fluorescent substance is coated on the light transmission function member and/or its periphery.

Further, according to the invention of the fifth aspect, it is characterized in that the external light lighting hole is provided on the lower side.

According to the structure described as above, when the transfer sheet P and the image receiving sheet R are superimposed at the time of insertion, because, by using such the insertion platform, both sheets are viewed being made transparent by the light from the lower side, the superimposition of match-marks of (+) mark of both sheets can be correctly conducted, accordingly, even when the operator is not a skilled person, the positioning can be correctly conducted without spending a long period of time.

Further, according to the invention of the sixth aspect, it is characterized in that the insertion platform is provided with a cutout having the length in which the operator can continuously have the superimposed sheets until the leading edge of both sheets in the superimposed condition is nipped.

According to the structure as described above, the operator can securely insert the correctly positioned superimposed sheets of the transfer sheet P and the image receiving sheet R from the insertion platform into the device, while he having the superimposed sheets.

According to the invention of the seventh aspect, it is characterized in that the insertion platform for the image transfer apparatus of any one of the first aspect to the fifth aspect, and the heat roller pair to heat and press the superimposed sheets entering from the insertion platform, are provided.

According to the structure as described above, because the image transfer apparatus has the insertion platform as described above, the image transfer apparatus can transfer the correctly positioned transfer sheet P and the image receiving sheet R, and can transfer the fine image having no image slippage and no indent.

BRIEF DESCRIPTION OF THE DRAWINGS

FIGS. 5(*a*), 5(*a'*); 5(*b*), 5(*b'*) and 5(*c*), 5(*c'*) show steps to conduct the insertion of a superimposed sheet by using a mark and cutout in FIG. 3.

DESCRIPTION OF THE PREFERRED EMBODIMENTS

Figure 1:
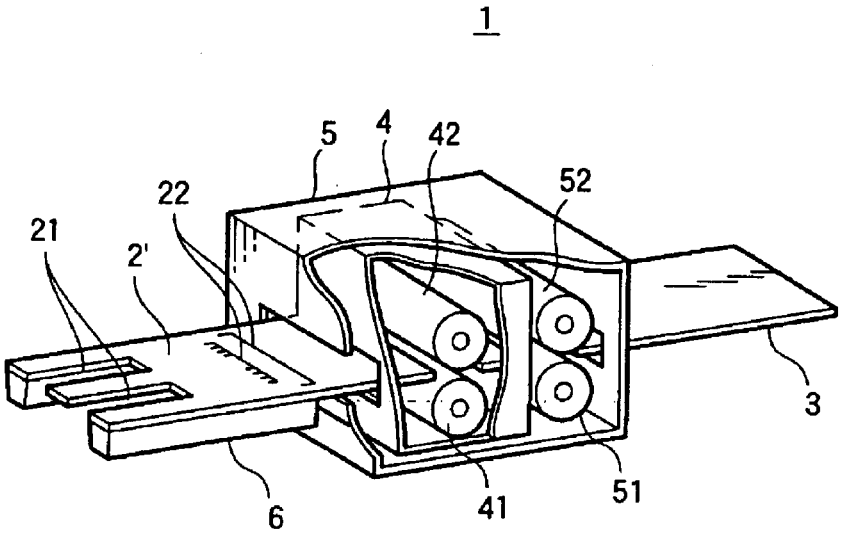
FIG. 1 is a partial sectional perspective view of an image transfer apparatus according to the present invention.

Referring to the drawings, an embodiment of the present invention will be described below. FIG. 1 is a partial sectional perspective view of an image transfer apparatus according to the present invention, and FIG. 2 is a partial sectional side view for explaining the image transfer using the image transfer apparatus in FIG. 1.

Figure 12:
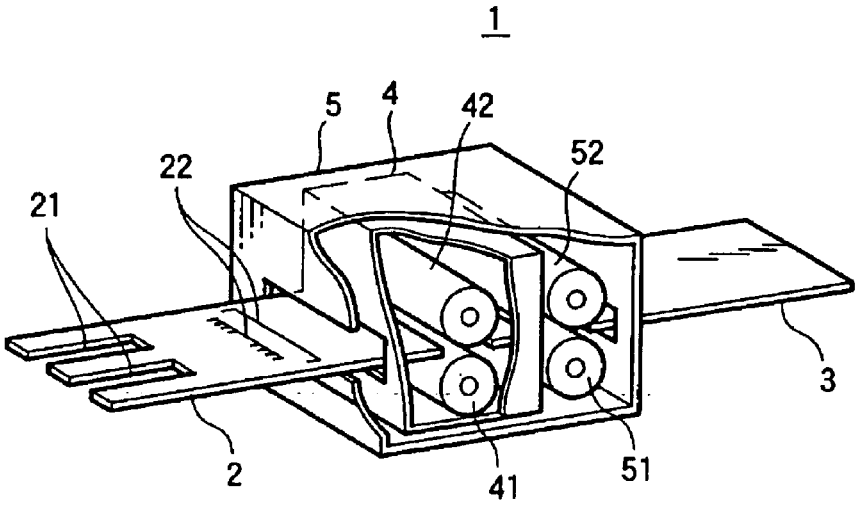
FIG. 12 is a partial sectional perspective view of the image transfer apparatus according to the preceding invention.
Figure 13:
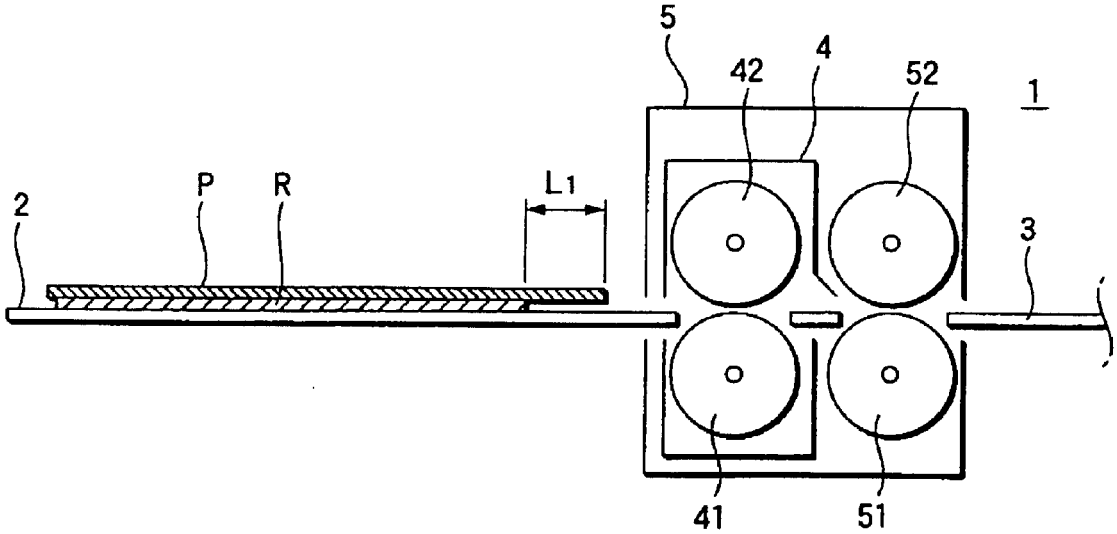
FIG. 13 is a view for explaining the image transfer using the image transfer apparatus in FIG. 12.

In FIG. 1, numeral 1 is the image transfer apparatus, and is the same structure as the image transfer apparatus described in FIG. 12 except for an insertion platform 2' according to the present invention. That is, it is structured by the heat roller pair 41 and 42, heat cover 4 to cover it, nip roller pair 51 and 52, protective cover 5 to cover the heat cover 4 and the nip roller pair 51 and 52, insertion platform 2', and delivery base 3.

A part or the whole of the insertion platform 2' is structured by a member having a function which transmits the light from the lower side. That is, as the light transmission function member, the member having the transparent, translucent, or light diffusion function, such as the transparent glass, obscured glass, and plastic material similar to these, is listed. Further, when the recording medium has the rigidity, it may be a member having only an opening. Then, a box 6 which will be detailed in FIG. 4, is attached to the lower side of the insertion platform 2', and when the fluorescent lamp in the box 6 is turned on, the insertion platform 2' is illuminated from the lower side.

Figure 2:
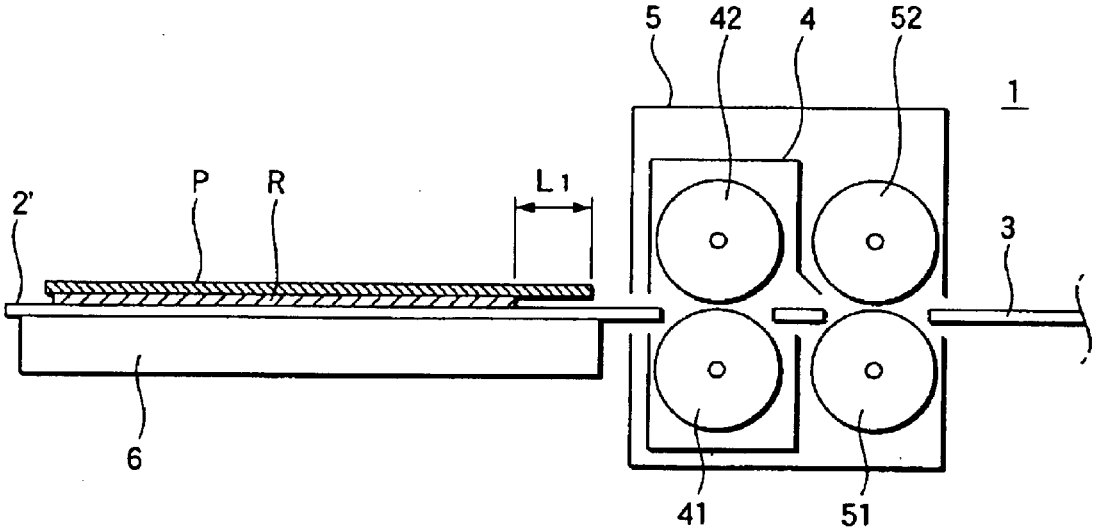
FIG. 2 is a partial sectional side view for explaining the image transfer using the image transfer apparatus in FIG. 1.

In FIG. 2, sign R on the insertion platform 2' of the image transfer apparatus 1 is the image receiving sheet on which the image is formed, and sign P superimposed on it, is the transfer sheet onto which the image is to be transferred. In this case, because the transfer sheet P whose size is larger than the image receiving sheet R is superimposed on the image receiving sheet R, the correct positioning is difficult in the same manner as the preceding invention has trouble, however, according to the present invention, because the insertion platform 2' is illuminated from the lower side, and the image receiving sheet R is placed on the insertion platform 2' and next, the transfer sheet P is superimposed on it, and the image receiving sheet R is illuminated by the light from the lower side and the match-mark of the image receiving sheet R can be visually confirmed from above the transfer sheet P, the match-mark provided on the corner of the transfer sheet P can be easily and correctly matched with that of the image receiving sheet R.

Figure 3:
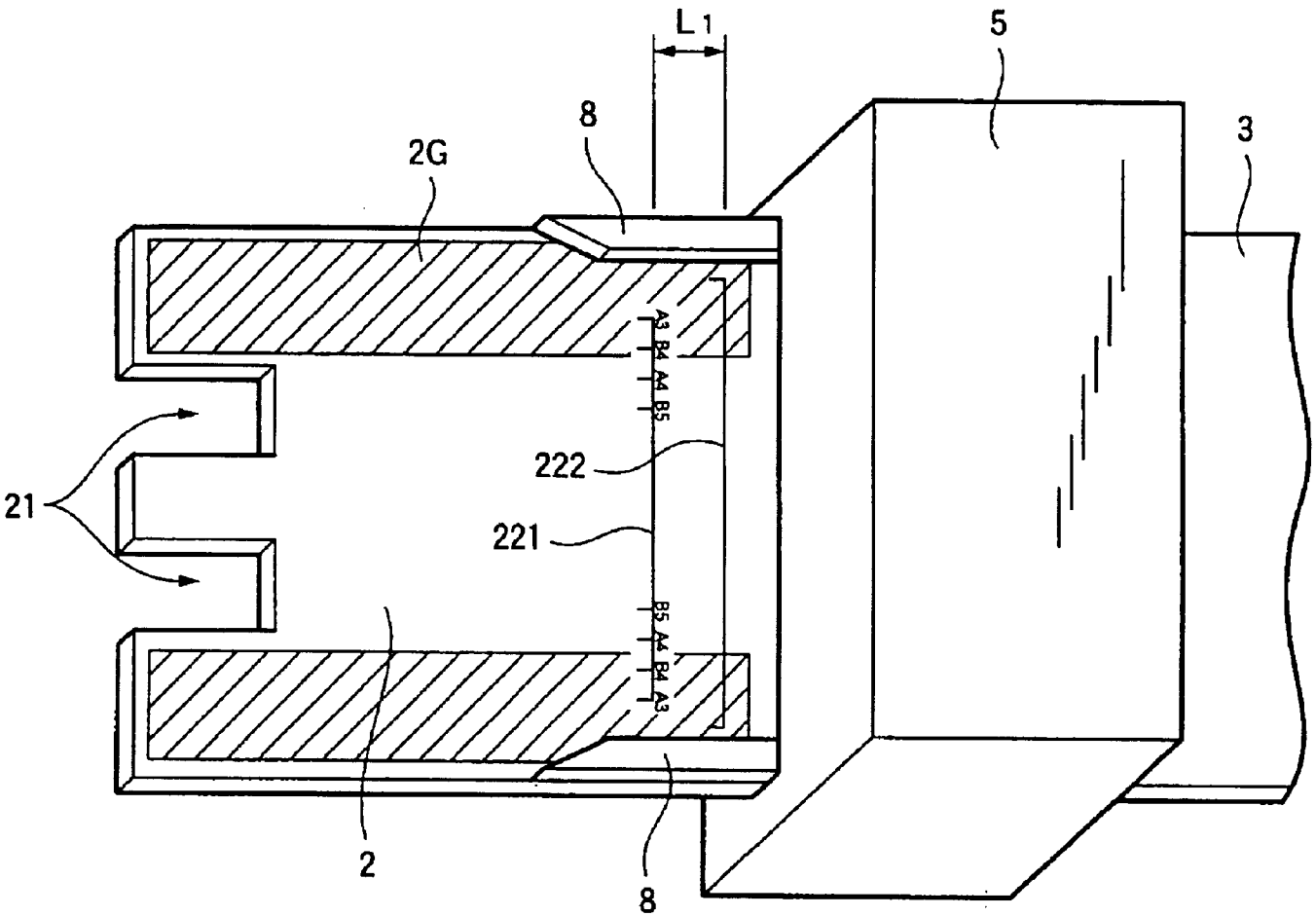
FIG. 3 is a perspective view of an insertion platform 2' in FIG. 2.

In this case, the positional relationship of the image receiving sheet and the transfer sheet P is such that, as shown in FIG. 2, the transfer sheet P is inserted in front of the image receiving sheet R by more than L1 (L1 =21 mm). According to that, because only the transfer sheet P is passed, and next, the superimposed portion with the image receiving sheet R is passed, the jam is reduced. In order to perform this, as shown in FIG. 3, it is preferable that a mark is put at a portion corresponding to the positional relationship of the image receiving sheet R and the transfer sheet P on the insertion platform 2. FIG. 3 is a perspective view of the insertion platform 2' in FIG. 2. A mark 221 is for the image receiving sheet R, and corresponding to the size of the image receiving sheet R, A3, B4, A4, and B5 are respectively written. At the distance L1 (about 21 mm) in font of the mark 221, a mark 222 for the transfer sheet P is put. By using these marks, the positioning is roughly made, and next, when, by using the light transmission function portion 2G, the match-marks are matched with each other, the accurate positioning can be quickly and easily performed.

Figure 4B:
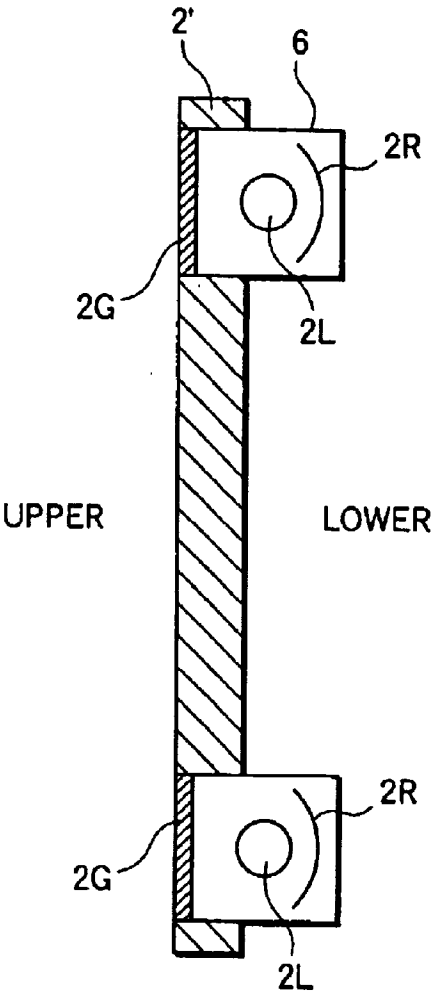
FIG. 4(*a*) and FIG. 4(*b*) show a plan view A and a front view B of the insertion platform in FIG. 3.
Figure 4A:
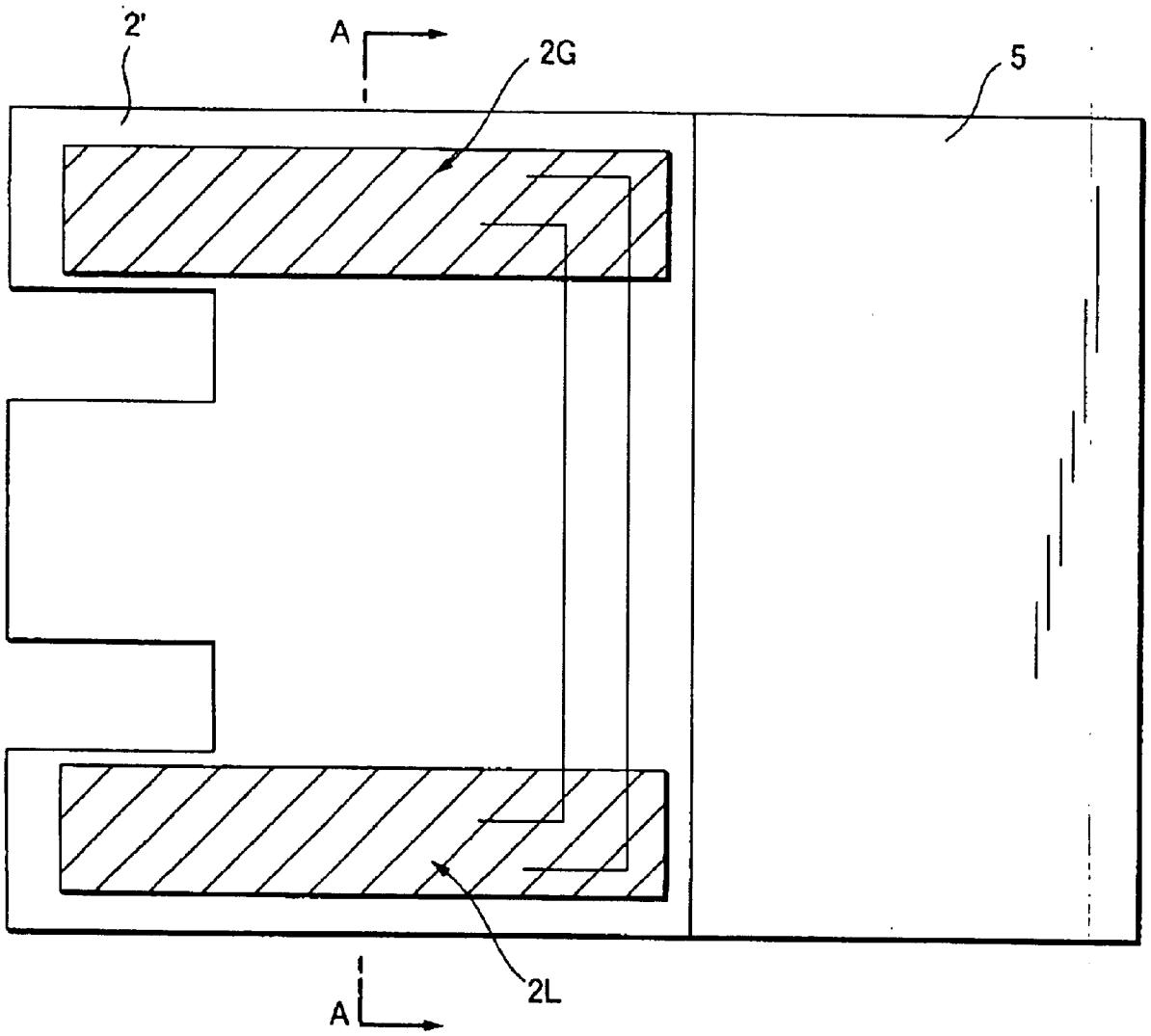

FIG. 4 shows a plan view A and a front view B of the insertion platform in FIG. 3. Numeral 2' is the insertion platform and numeral 2G is a glass portion, and numeral 5 is a transfer cover. Below the glass portion 2G of the insertion platform 2', the box 6 in which the fluorescent lamp 2L and the reflection plate 2R to reflect upward the light of the fluorescent lamp 2L are housed, is attached.

According to such the structure, when the fluorescent lamp 2L is turned on, the glass portion 2G is illuminated from below. Accordingly, the image receiving sheet R is illuminated by the light from the lower side, and because the match-mark of the image receiving sheet R can be visually confirmed from above the transfer sheet P, the mark can be correctly and easily matched with the match-mark provided at the corner of the transfer sheet.

Although, herein, as the light source, the fluorescent lamp 2L is used, of course, the present invention is not limited to the fluorescent lamp, but another light source such as the light emitting diode, EL, or incandescent lamp, may also be allowable.

In this manner, a cutout 21 is provided on the insertion platform 2 so that the sheets can be held until the leading edge of both sheets in the correctly superimposed condition, is nipped. Accordingly, it is preferable that the length of the cutout 21 is a length to a degree in which the minimum sized image receiving sheet in the image receiving sheets to be used, is nipped by the heat rollers 41 and 42.

In this connection, numeral 8 in FIG. 3 is a sheet passing inhibition plate having the thickness of about 1.5 mm. By the sheet passing inhibition plate 8, it is inhibited that the superimposed sheets are passed out of the range of heat rollers 41 and 42.

FIG. 5 shows steps by which, by using such the marks 221, 222 and the cutout 21, the superimposed sheets are inserted.

(1) Initially, the image receiving sheet R is placed on the insertion platform 2 with the recording surface facing the upward, matching its mark with the mark 221 of the insertion platform 2 (FIG. 5A).

(2) Next, the transfer sheet P is placed on the image receiving sheet R matching its mark with the mark 222, and then, the match-marks of both sheets are matched with each other (FIG. 5).

(3) After the match-marks of both sheets can be matched, the end portions of the conveyance direction of the image receiving sheet and the transfer sheet are held by hands at the cutout 21 being superimposed with each other, and are pushed into the image transfer apparatus (FIG. 5C).

(4) While the sheets are being held by hands, the sheets are further pushed along the cutout 21.

(5) When the leading edges of both sheets are nipped by the heat rollers 41 and 42 in the image transfer apparatus cover 5, the hands are separated.

According to this, because the superimposed sheets are not lifted, and can be inserted horizontally, the wrinkle is hardly generated. Further, because the sheets are nipped at the end of the cutout of the insertion platform, the hands may be separated.

Then, when the superimposed sheets are conveyed on the delivery base 3, both sheets of the superimposed sheets are peeled by hands, and when the transfer sheet is taken away, the transfer is completed.

Figure 6B:
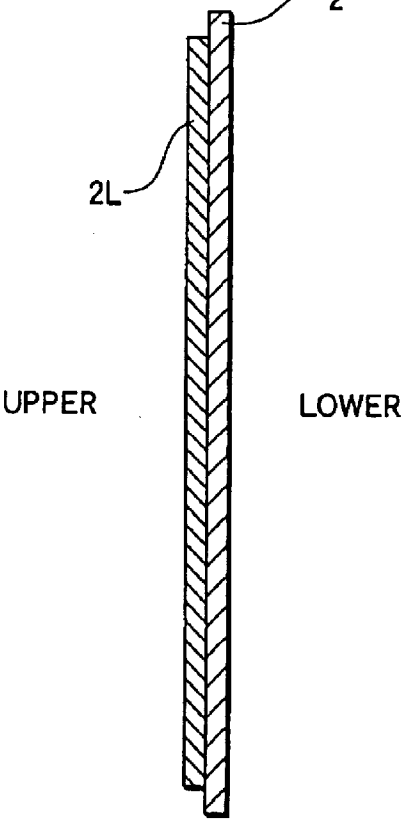
FIG. 6(*a*) and FIG. 6(*b*) show the second embodiment of the present invention.
Figure 6A:
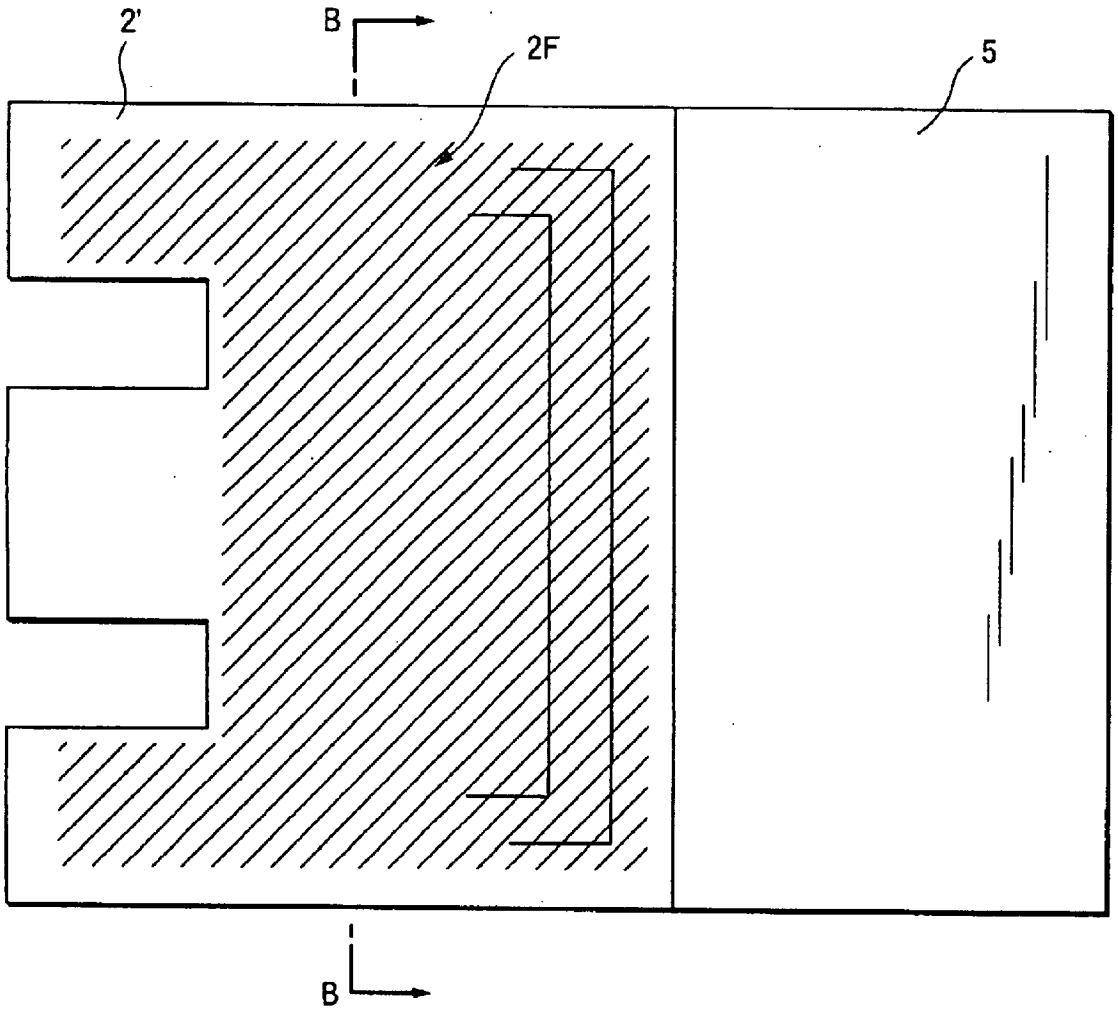

FIG. 6 shows the second embodiment of the present invention, and instead of the box 6 in which the fluorescent lamp 2L and the reflection plate 2R are housed, in FIG. 4, the light accumulation fluorescent substance 2F is coated on a part or the whole surface on the insertion platform 2'. The light accumulation fluorescent substance is excited by even a slight light and lightened, and maintains this condition for a long period of time. By using such the light accumulation fluorescent substance 2F, the light accumulation fluorescent substance 2F is excited by a slight external light and lightened, and the insertion platform 2' is illuminated. Accordingly, in this condition, when the image receiving sheet R is placed on the insertion platform, the image receiving sheet R is illuminated from the lower side, and because the match-mark of the image receiving sheet R can be visually confirmed from above the transfer sheet P, when the transfer sheet P is placed on it, the match-mark of the image receiving sheet R can be simply and correctly matched with the match-mark provided at the corner of the transfer sheet P.

Figure 7B:
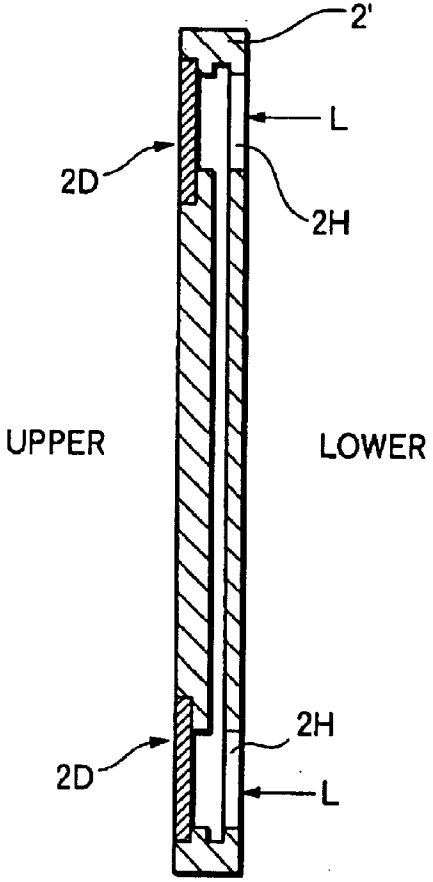
FIG. 7(*a*) and FIG. 7(*b*) show the third embodiment of the present invention.
Figure 7A:
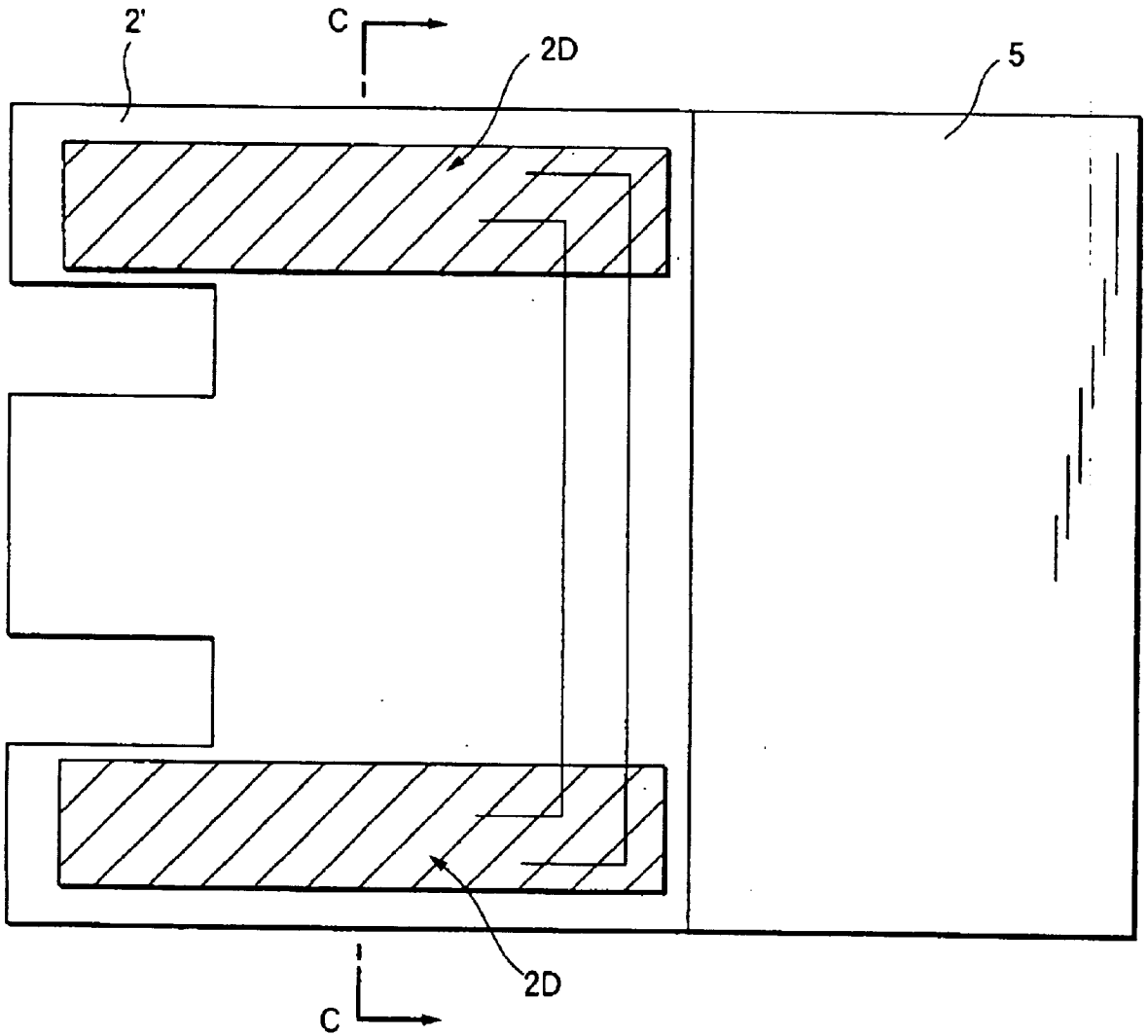
Figure 8:
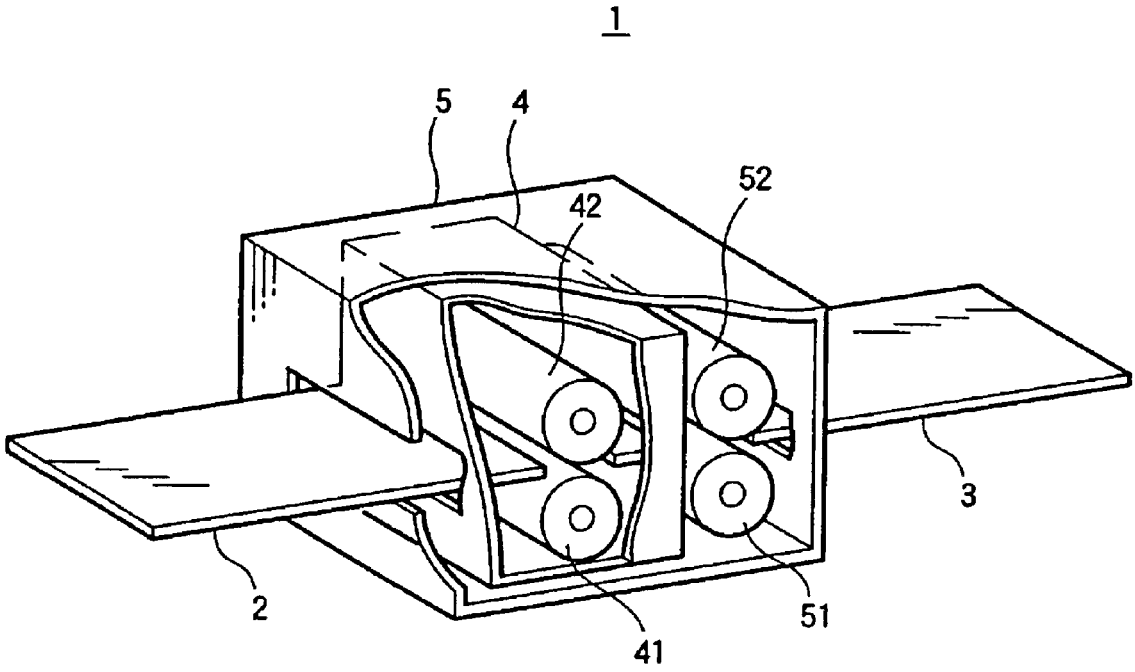
FIG.8 PRIOR ART
FIG. 8 is a partial sectional perspective view of the conventional image transfer apparatus.
Figure 9:
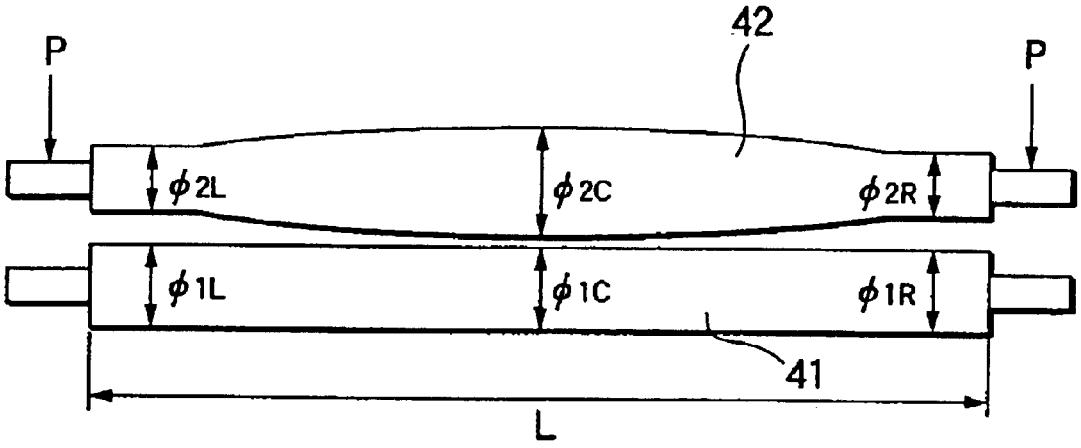
FIG.9 PRIOR ART
FIG. 9 is a view for explaining the shape of a heat roller pair 41 and 42.
Figure 10:
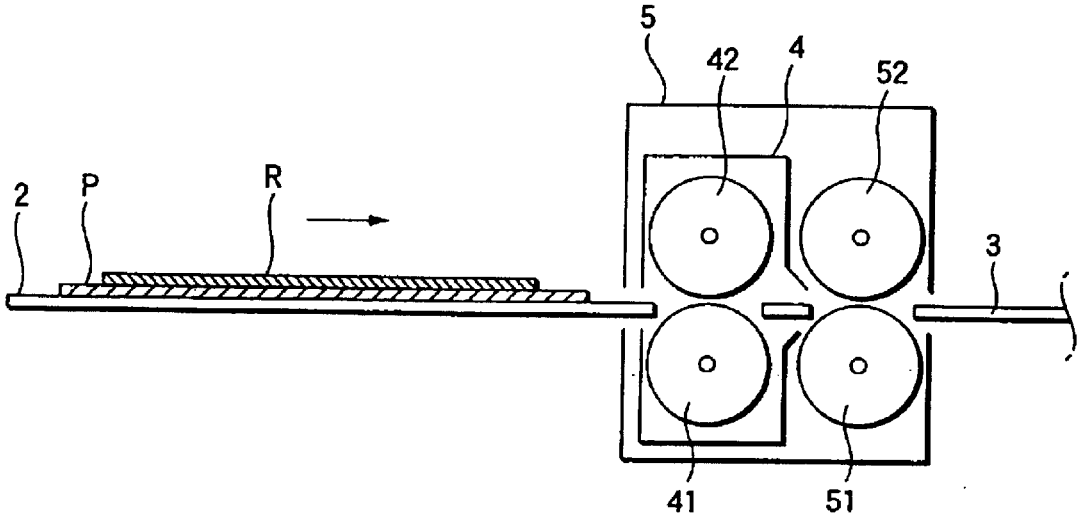
FIG.10 PRIOR ART
FIG. 10 is a view for explaining the image transfer using the image transfer apparatus in FIG. 8.
Figure 11:
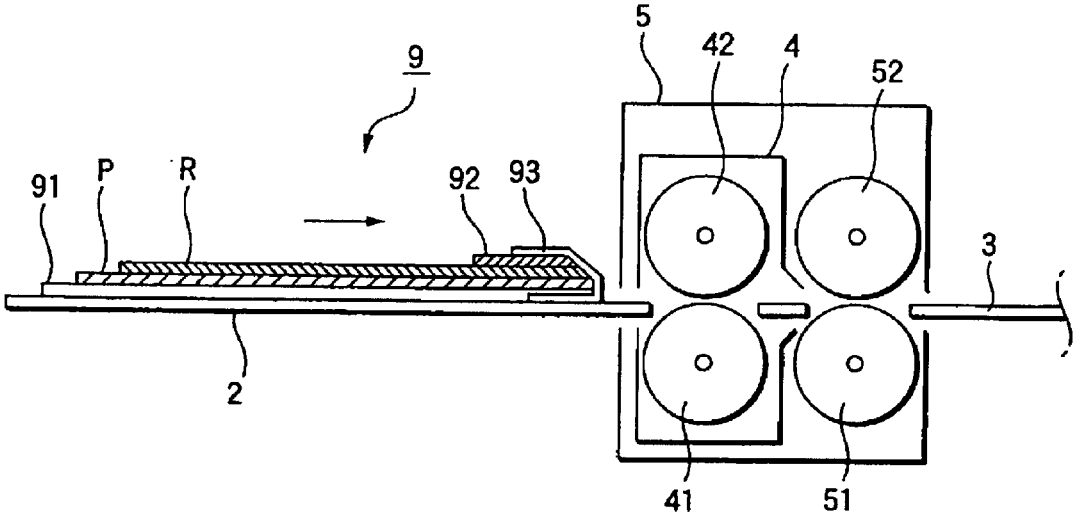
FIG.11 PRIOR ART
FIG. 11 is a view for explaining another image transfer using the image transfer apparatus in FIG. 8.

FIG. 7 shows the third embodiment of the present invention, and instead of the fluorescent lamp 2L and the reflection plate 2R in FIG. 4, the transparent member 2D such as the transparent glass or obscured glass is attached onto a part or the whole surface of the insertion platform 2', and as the light source, the bright external light is used. For that, an external light lighting hole 2H is provided in the lower portion of the insertion platform 2', and the bright external light L is taken into the inside of the insertion platform 2' through this external light lighting hole 2H.

According to the structure described above, when the external light L is incident from the lower side of the glass member 2D, the glass member 2D is illuminated, and accordingly, the image receiving sheet R is illuminated by this lightness, and because the match-mark of the image receiving sheet R can be visually confirmed from above the transfer sheet P, the match-mark of the image receiving sheet R can be simply and correctly matched with the match-mark provided at the corner of the transfer sheet P.

When the insertion platform as described above is arranged as the insertion platform of the image transfer apparatus, because the positioning of the image receiving sheet R with the transfer sheet P can be simply and correctly conducted, the insertion platform is easily usable and convenient also for the image transfer apparatus.

As described above, when the insertion platform of the present invention is used, because the positioning of a small sized image receiving sheet and a transfer sheet which is placed on the image receiving sheet and has the larger size than it, can be simply and correctly conducted, the image transfer in which no image slippage is generated, and the convex and concave-shaped wrinkle is not generated, can be quickly and simply conducted.

What is claimed is:

1. An insertion platform for an image transfer apparatus in which an image receiving sheet on which an image is formed, and a transfer sheet onto which an image is to be transferred, are superimposed on each other, and is sent into a heat roller pair inside the image transfer apparatus to heat and press the sheets, the insertion platform for an image transfer apparatus wherein a part or the whole of the insertion platform is structured by a member provided with a function to transmit the light from the lower side, wherein the insertion platform for an image transfer apparatus is provided with a cutout having a length in which the operator can continue to have the leading edge of both sheets in the superimposed condition until it is nipped.

2. An insertion platform for an image transfer apparatus according to claim 1, wherein a pair of alignment marks are formed on said insertion platform to allow said image receiving sheet and said transfer sheet to be aligned at the superimposed conditions respectively.

3. An insertion platform for an image transfer apparatus in which an image receiving sheet on which an image is formed, and a transfer sheet onto which an image is to be transferred, are superimposed on each other, and is sent into a heat roller pair inside the image transfer apparatus to heat and press the sheets, the insertion platform for an image transfer apparatus wherein a part or the whole of the insertion platform is structured by a member provided with a function to transmit the light from the lower side, wherein the light transmission member is any one of a transparent portion, translucent portion, light diffusion portion, or opening portion, and wherein the insertion platform for an image transfer apparatus is provided with a cutout having a length in which the operator can continue to have the leading edge of both sheets in the superimposed condition until it is nipped.

4. An insertion platform for an image transfer apparatus according to claim 3, wherein a pair of alignment marks are formed on said insertion platform to allow said image receiving sheet and said transfer sheet to be aligned at the superimposed conditions respectively.

5. An insertion platform for an image transfer apparatus in which an image receiving sheet on which an image is formed, and a transfer sheet onto which an image is to be transferred, are superimposed on each other, and is sent into a heat roller pair inside the image transfer apparatus to heat and press the sheets, the insertion platform for an image transfer apparatus wherein a part or the whole of the insertion platform is structured by a member provided with a function to transmit the light from the lower side, wherein the light transmission member is any one of a transparent portion, translucent portion, light diffusion portion, or opening portion, wherein the insertion platform for an image transfer apparatus has a light source on its lower side, and wherein the insertion platform for an image transfer apparatus is provided with a cutout having a length in which the operator can continue to have the leading edge of both sheets in the superimposed condition until it is nipped.

6. An insertion platform for an image transfer apparatus according to claim 5, wherein a pair of alignment marks are formed on said insertion platform to allow said image receiving sheet and said transfer sheet to be aligned at the superimposed conditions respectively.

7. An insertion platform for an image transfer apparatus in which an image receiving sheet on which an image is formed, and a transfer sheet onto which an image is to be transferred, are superimposed on each other, and is sent into a heat roller pair inside the image transfer apparatus to heat and press the sheets, the insertion platform for an image transfer apparatus wherein a part or the whole of the insertion platform is structured by a member provided with a function to transmit the light from the lower side, wherein the light transmission member is any one of a transparent portion, translucent portion, light diffusion portion, or opening portion, wherein a light accumulation fluorescent substance is coated on the light transmission function member and/or its periphery, and wherein the insertion platform for an image transfer apparatus is provided with a cutout having a length in which the operator can continue to have the leading edge of both sheets in the superimposed condition until it is nipped.

8. An insertion platform for an image transfer apparatus according to claim 7, wherein a pair of alignment marks are formed on said insertion platform to allow said image receiving sheet and said transfer sheet to be aligned at the superimposed conditions respectively.

9. An insertion platform for an image transfer apparatus in which an image receiving sheet on which an image is formed, and a transfer sheet onto which an image is to be transferred, are superimposed on each other, and is sent into a heat roller pair inside the image transfer apparatus to heat and press the sheets, the insertion platform for an image transfer apparatus wherein a part or the whole of the insertion platform is structured by a member provided with a function to transmit the light from the lower side, wherein the light transmission member is any one of a transparent portion, translucent portion, light diffusion portion, or opening portion, wherein the insertion platform for an image transfer apparatus is provided with an external light lighting hole on its lower side, and wherein the insertion platform for an image transfer apparatus is provided with a cutout having a length in which the operator can continue to have the leading edge of both sheets in the superimposed condition until it is nipped.

10. An insertion platform for an image transfer apparatus according to claim 9, wherein a pair of alignment marks are formed on said insertion platform to allow said image receiving sheet and said transfer sheet to be aligned at the superimposed conditions respectively.

11. An image transfer apparatus comprising the insertion platform for an image transfer apparatus of one of claims 1 and 3 to 10; and a heat roller pair which heats and presses the superimposed sheets entering from the insertion platform.

* * * * *